US010405671B2

(12) United States Patent
Emile

(10) Patent No.: US 10,405,671 B2
(45) Date of Patent: Sep. 10, 2019

(54) BED MAKER

(71) Applicant: Jean Emile, Richmond, VA (US)

(72) Inventor: Jean Emile, Richmond, VA (US)

( * ) Notice: Subject to any disclaimer, the term of this patent is extended or adjusted under 35 U.S.C. 154(b) by 329 days.

(21) Appl. No.: 15/249,752

(22) Filed: Aug. 29, 2016

(65) Prior Publication Data

US 2018/0055238 A1 Mar. 1, 2018

(51) Int. Cl.
*A47C 21/02* (2006.01)

(52) U.S. Cl.
CPC ..... *A47C 21/022* (2013.01); *A47C 21/02* (2013.01); *A47C 21/028* (2013.01); *Y10T 24/23* (2015.01)

(58) Field of Classification Search
CPC ..... A47C 21/00; A47C 21/02; A47C 21/022; A47C 21/028; A44C 5/0007; Y10T 24/23
USPC ..... 24/72.5
See application file for complete search history.

(56) References Cited

U.S. PATENT DOCUMENTS 856,052 A * 6/1907 Grandjean ..... A47C 21/022 2/209
1,156,740 A * 10/1915 Berdan ..... A47C 21/022 24/72.5
2,772,460 A * 12/1956 Berkowicz ..... A47D 15/02 24/68 R
2,930,053 A * 3/1960 Nowels ..... A47C 21/022 5/212
3,296,668 A * 1/1967 Aiken ..... A47C 21/022 24/51
4,199,830 A * 4/1980 Ogata ..... A47C 21/022 24/72.5
4,829,617 A * 5/1989 Dameron ..... A47C 21/022 24/306
5,014,399 A * 5/1991 Grisel ..... A47C 21/022 24/490
5,072,470 A * 12/1991 Lysiak ..... A47C 21/022 5/496
5,148,560 A * 9/1992 Torres ..... A47C 21/022 24/72.5
5,377,391 A * 1/1995 Foster ..... A47C 21/022 24/301
D436,489 S * 1/2001 Farrugia ..... A47C 21/022 D6/607
6,185,766 B1 * 2/2001 Farrugia ..... A47C 21/022 24/72.5
7,698,759 B1 * 4/2010 Frasier ..... A47C 21/022 24/72.5
8,365,361 B1 * 2/2013 Ahern ..... A47C 21/02 24/338

(Continued)

*Primary Examiner* — Robert G Santos
*Assistant Examiner* — David R Hare
(74) *Attorney, Agent, or Firm* — Kilpatrick Townsend & Stockton LLP

(57) ABSTRACT

Disclosed are various embodiments for retaining a sheet on a mattress. A membrane comprising a plurality of extensions disposed along the perimeter of the membrane is displaced underneath a mattress. The extensions of the membrane are composed of an elastic material and the membrane is composed of a material that generates sufficient friction when in contact with the mattress to be displaced. The extensions are configured to retract to an original length, wherein the original length of each extension corresponds to a size of the mattress. Additionally, the extensions are disposed at a distance apart from each other so as to substantially retain a sheet applied on the mattress.

5 Claims, 5 Drawing Sheets

(56) References Cited

U.S. PATENT DOCUMENTS

| | | | | |
|---|---|---|---|---|
| 8,429,773 | B2 * | 4/2013 | Herman | A47C 21/022 24/72.5 |
| 8,839,494 | B1 * | 9/2014 | Screens | A41F 17/04 24/300 |
| D769,030 | S * | 10/2016 | Acres | A47C 21/022 D6/607 |
| 9,844,276 | B1 * | 12/2017 | Phillips | A47C 21/022 |
| 2002/0062522 | A1 * | 5/2002 | Deckert | A47C 21/022 5/504.1 |
| 2009/0172881 | A1 * | 7/2009 | Peterson | A47C 21/022 5/496 |
| 2012/0005867 | A1 * | 1/2012 | Whaley | A47C 21/022 24/302 |
| 2014/0283301 | A1 * | 9/2014 | Whaley | A47C 21/022 5/496 |
| 2015/0020352 | A1 * | 1/2015 | Funger | A47C 31/11 24/301 |
| 2015/0327685 | A1 * | 11/2015 | Longnecker | A47C 21/022 5/498 |
| 2017/0035210 | A1 * | 2/2017 | Nekhala | A47G 11/004 |

* cited by examiner

BED MAKER

BACKGROUND

Conventional apparatuses and mechanisms for retaining sheets on mattresses, such as sheet clips and fasteners, bed skirt pins, bed suspenders, sheet straps, and the like, do not adequately retain sheets in place and frequently cause damage to the sheets and/or the underlying mattress. Further, these conventional apparatuses and mechanisms involve retaining the sheets on the mattress at the corners while neglecting the side portions. For instance, sheet clips retain the sheet in place by being positioned at the corners of the mattress and grasping the sheet at the corner. The sides of the sheet remain free. While bed skirt pins may retain the sheet along the entire perimeter rather than just the corners, the pins themselves pierce through fabric causing permanent damage to the sheets and/or mattress.

None of the conventional apparatuses and mechanisms account for unintended shifting and sliding of bed covers. For example, sitting and/or lying on a mattress with a sheet causes the sheet to shift and slide which may result in damage to the sheet if retained too tightly. Additionally, conventional apparatuses and mechanisms may require installation upon every use. For instance, these apparatuses may need to be installed every time by lifting each corner of the mattress and/or the entire mattress to position the apparatus in place when the sheet is replaced.

SUMMARY

In one embodiment, a method is provided. The method comprises inserting a membrane underneath a mattress, the membrane comprising a plurality of extensions protruding along the perimeter of the membrane, the extensions comprising an elastic material configured to retract to an original length, and wherein the extensions total a number sufficient to substantially retain a sheet applied on the mattress. The method further comprises affixing a plurality of clips to an end of a respective extension of the membrane, the clips being composed of a rubber material, and applying each clip to at least a portion of the sheet to substantially retain the sheet on the mattress.

In another embodiment, a clip to firmly retain a sheet on a mattress is disclosed. The clip to firmly retain a sheet on a mattress comprises two halves that fasten together to firmly retain the sheet. The first half of the two halves being affixed to a body of the clip and a second half of the two halves being tethered to the first half, and the first half comprising a receptacle to receive and secure an extension of a membrane disposed underneath a mattress.

In another embodiment, a membrane is disclosed. The membrane comprises a plurality of extensions disposed along a perimeter of the membrane, wherein the extensions are composed of an elastic material. The membrane is disposed underneath a mattress and is composed of a material that generates sufficient friction when in contact with the mattress to be securely disposed. The extensions are configured to retract to an original length, the original length of each extension corresponding to a size of the mattress. Additionally, the extensions are disposed at a distance apart from each other so as to substantially retain a sheet applied on the mattress.

DETAILED DESCRIPTION

Disclosed are features for a membrane disposed underneath a mattress for retaining a sheet on the mattress. The membrane includes extensions comprised of a material capable of expanding and retracting to various lengths in order to retain the sheet. These extensions protrude along the perimeter of the membrane and may be disposed at varying distances between each other. For example, in some instances, the extensions may be disposed close to each other to enhance retention capabilities of the membrane. In other instances, the extensions may be disposed farther apart from each other and still maintain retention capabilities of the membrane.

A clip is affixed at the end of each extension. The clip can be applied to a portion of the sheet to be retained on the mattress. The clip has two halves—a first half affixed to the extension of the membrane and a second half tethered to the first half. In some embodiments, the second half may not be connected to the extension. To retain the sheet, a portion of the sheet is inserted between the two halves which are then fastened together to secure the sheet within the clip. The halves may be fastened together, for example, by a button or the like. In some embodiments, the clip is comprised of a material capable of gentle treatment of the sheet to be retained. For example, the clip may be composed of a rubbery material that gently secures the sheet within the clip when the two halves are fastened together.

In operation, the clips affixed to the extensions and the membrane firmly retain the sheet on top of the mattress. The membrane disposed underneath the mattress is securely positioned by friction generated between the membrane and the mattress when in contact. Once the sheet has been inserted between the two halves of the clips and the clip fastened together, the extensions of the membrane operate to retain the sheet at a desired tension. For example, the extensions are designed to stretch and retract to compensate for unintended and/or unwanted shifting of the sheet. In some instances, the stretching and retracting may be automatic in response to the unintended and/or unwanted shifting.

Figure 1:
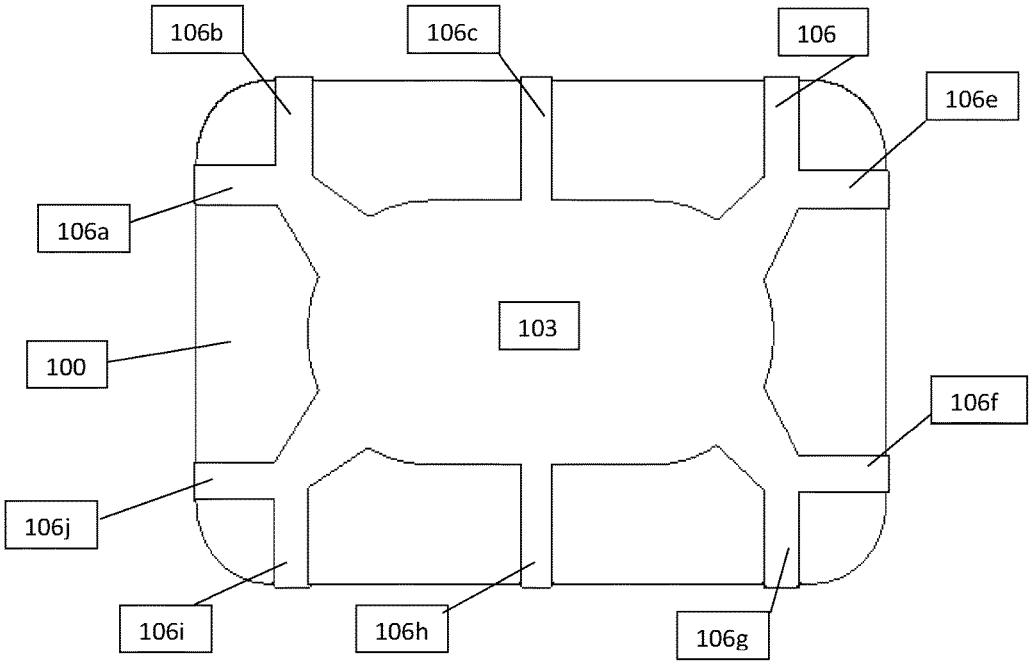
FIG. 1 is a bottom view of a mattress with a membrane affixed to the underside of the mattress.

FIG. 1 illustrates an underside of a mattress 100 depicting a membrane 103 and extensions **106*a*-106*j* protruding from the perimeter of the membrane 103. The membrane 103 is smaller in size than the mattress 100 and may be circular in shape. In other embodiments, the membrane may be of a different shape such as a square, rectangle, triangle, or other shape sufficient to have a perimeter from which extensions 106 can protrude. Additionally, the extensions 106** have a thickness such that they can retain the sheet without tearing.

Extensions 106 may be disposed at varying distances apart from each other along the perimeter. The extensions 106 are disposed apart from each other at a sufficient distance such that the sheet can be retained by the membrane 103 at a desired tension. In some embodiments, the distance apart may be uniform between all extensions 106. In other embodiments, distances between each of the respective extensions 106 may differ. In still other embodiments, distances between extensions 106 disposed along the top and bottom sides of the membrane 103 may be the same and distances between extensions 106 disposed along the left and right sides of the membrane 103 may be the same. Additionally, in other embodiments, the distance between extensions 106 along the corners of the membrane 103 may differ with the distance between extensions 106 disposed along the sides of the membrane 103.

Figure 2:
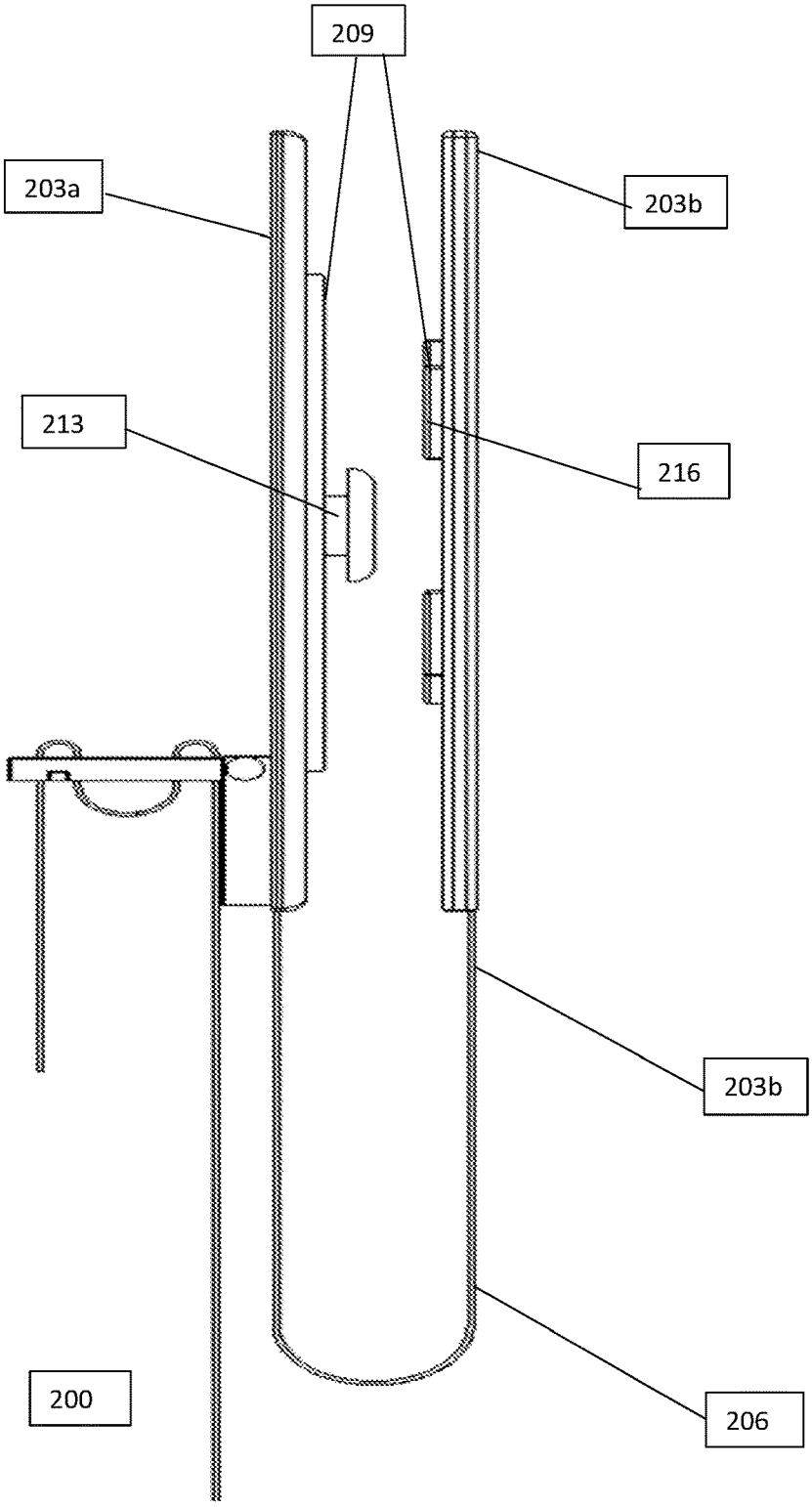
FIG. 2 depicts a clip affixed to the membrane used to retain a sheet on the mattress.

FIG. 2 illustrates a clip 200 to firmly retain a sheet on the mattress 100. In one embodiment, the clip 200 includes two halves, a first half 203*a* and a second half 203*b*, that fasten together to firmly retain the sheet. For example, the sheet may be received in at an area between the first half 203*a* and the second half 203*b*. The first half 203*a* and the second half 203*b* may be tethered together via a tether 206. In one embodiment the first half 203*a* is fixed to the body of the clip 200 and the second half 203*b* is tethered to the first half 203*a* by the tether 206.

The first half 203*a* and the second half 203*b* are fastened together via a fastener 209. The first half 203*a* of the clip 200 may include a male end 213 of the fastener 209 and the second half 203*b* of the clip 200 may include the female end 216 of the fastener 209. To retain the sheet, the sheet may be received between the first half 203*a* and the second half 203*b* and fastened together by the fastener 209, i.e. joining the male end 213 with the female end 216. The sheet is thusly retained by the clip 200.

The fastener 209 is designed to retain the sheet without causing any tears or perforations in the sheet. Preferably, the fasteners 209 does not cause any damage to the sheet when fastened together. To this end, the fastener 209 may be a snap or other type of fastener that does not diminish the integrity of the sheet. In one embodiment, the fastener 209 may be magnets that function to fasten the first half 203*a* of the clip 200 and the second half 203*b* of the clip 200 together using magnetics. For instance, the first half 203*a* may include a positive end of a magnet and the second half 203*b* may include a negative end of a magnet that join together when brought in close proximity.

Figure 3:
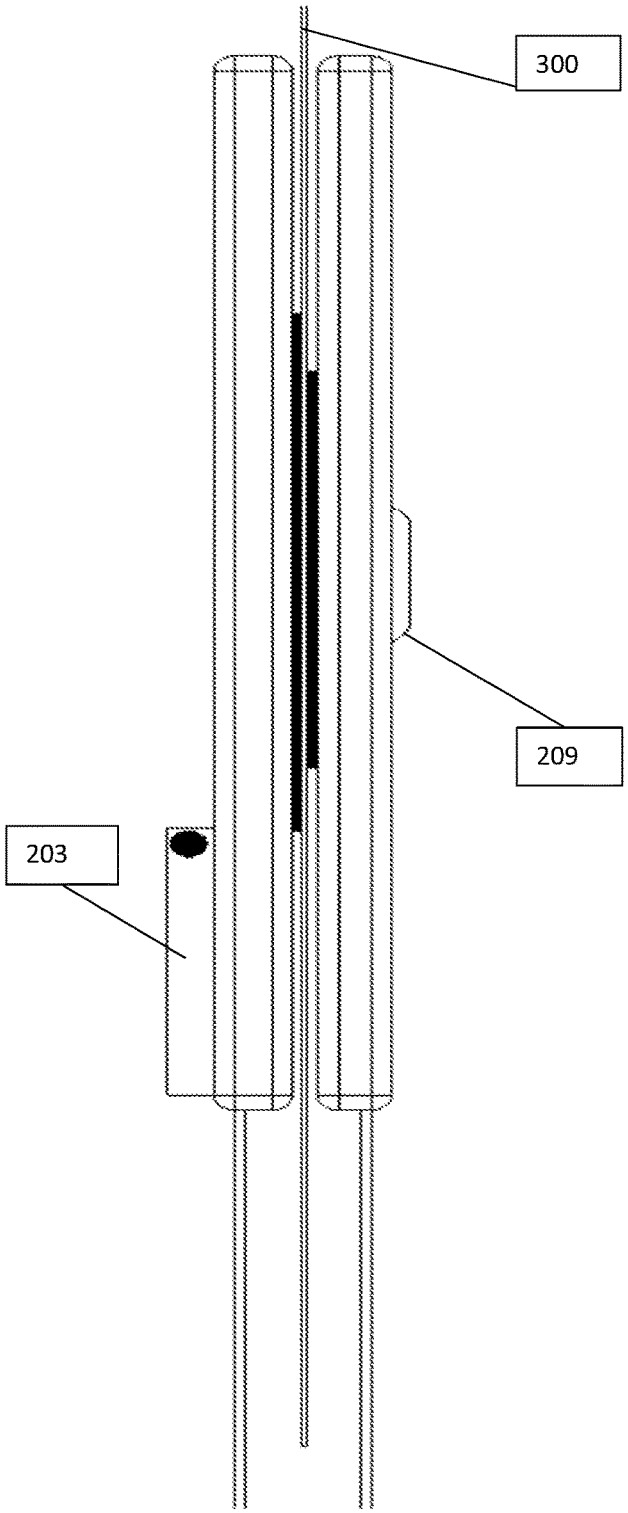
FIG. 3 shows a clip fastened around a portion of a sheet via a fastener.

FIG. 3 illustrates a clip 200 retaining a sheet 300 between the first half 203*a* of the clip 200 and the second half 203*b* of the clip. In one embodiment, the clip 200 only retains a portion of the sheet 300. As can be appreciated, the sheet 300 may have a surface area larger than that of the mattress 100. The portion of the sheet 300 retained by the clip 200 corresponds to the size of the fastener 209 of the clip 200.

Figure 4:
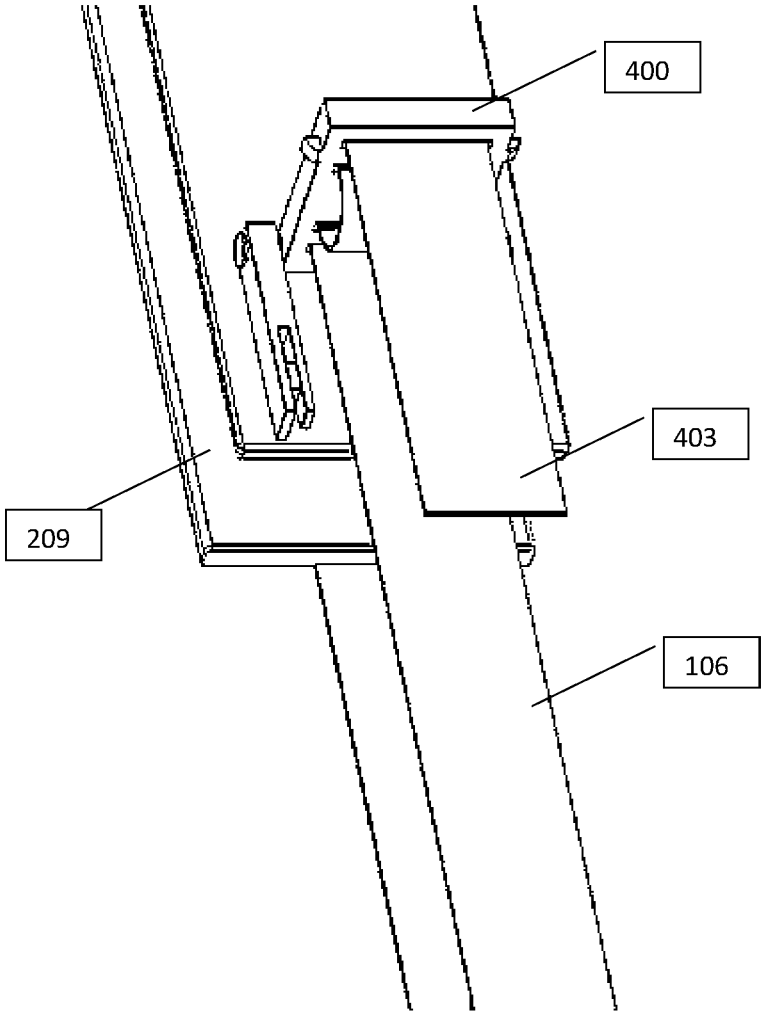
FIG. 4 illustrates a clip affixed to an extension of the membrane with an adjustable latching mechanism.

FIG. 4 illustrates a clip 200 affixed to an extension 106 of the membrane 103. In one embodiment, the clip 200 includes a latching mechanism 400 to affix the clip 200 to the extension 106. For example, the latching mechanism 400 may be a belt-buckle, or the like, configured to receive the extension 106 and secure the clip 200 to the extension 106. In one embodiment, an insertion 403 of the extension 106 is inserted into the latching mechanism 400, where the insertion 403 may be of various lengths. For example, a larger length for the insertion 403 may cause the clip 200 to apply a larger amount of tension on the sheet 300 when retained. Similarly, a smaller length for the insertion 403 may cause a smaller amount of tension on the sheet 300 when retained. Thus, varying the length of the insertion 403 may cause a variation in the tension of the sheet 300 when retained by the clips 200.

Figure 5:
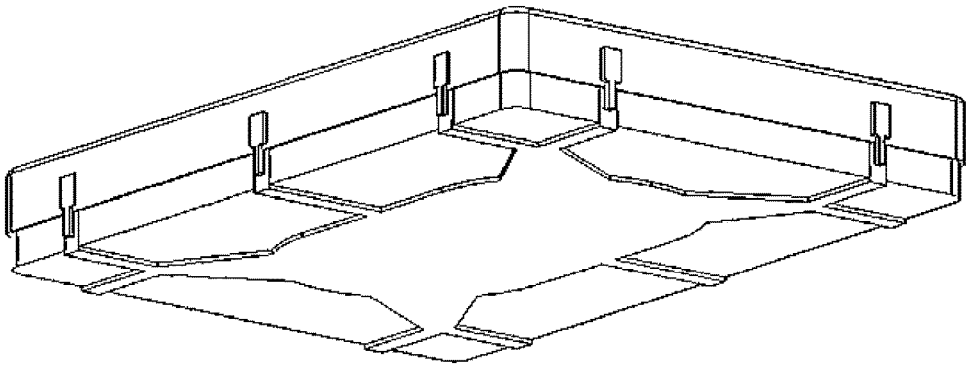
FIG. 5 is a bottom view illustrating the membrane retaining a sheet via the clips affixed to the extensions of the membrane.

FIG. 5 illustrates the membrane 103 retaining the sheet 300 on a mattress 100 using clips 200 that are affixed to the extensions 106 of the membrane 103. The sheet 300 may be fitted or rectangular and are retained at a desired tension by adjusting the length of the extension 106 inserted into the latching mechanism 400 of the clip 200.

The invention claimed is:

1. A membrane comprising:

a plurality of extensions disposed along a perimeter of the membrane, wherein the extensions are composed of an elastic material and wherein each extension is affixed to a clip that secures a sheet on top of a mattress;

the membrane being disposed underneath the mattress and being composed of a material that generates sufficient friction when in contact with the mattress to be securely disposed;

the extensions being configured to retract to an original length, the original length of each extension corresponding to a size of the mattress;

the extensions being disposed at a distance apart from each other so as to substantially retain a sheet applied on the mattress;

wherein each clip comprises two halves that fasten together to firmly retain the sheet;

a first half of the two halves being affixed to a body of the clip and a second half of the two halves being tethered to the first half; and the first half comprising a latching mechanism to receive and secure the respective extension of the a membrane disposed underneath a mattress.

2. The membrane of claim 1, wherein the sheet comprises at least one of a fitted sheet and a flat sheet.

3. The membrane of claim 1, wherein the extensions total a number sufficient to substantially retain the sheet.

4. The membrane of claim 1, wherein the extensions are configured to stretch to compensate for unintentional shifting of the sheet.

5. The membrane of claim 4, wherein the extensions are configured to automatically retract to the original length upon stretching.

* * * * *